US008402978B2

(12) United States Patent
Karles et al.

(10) Patent No.: US 8,402,978 B2
(45) Date of Patent: Mar. 26, 2013

(54) COATED IMPREGNATED POROUS FILTER PLUG

(75) Inventors: Georgios Karles, Richmond, VA (US); Shuzhong Zhuang, Richmond, VA (US); Yi Zeng, Richmond, VA (US); Hongwei Liu, Appleton, WI (US); Daqing Wu, Richmond, VA (US)

(73) Assignee: Philip Morris USA Inc., Richmond, VA (US)

( * ) Notice: Subject to any disclaimer, the term of this patent is extended or adjusted under 35 U.S.C. 154(b) by 505 days.

(21) Appl. No.: 12/577,008

(22) Filed: Oct. 9, 2009

(65) Prior Publication Data

US 2011/0083676 A1 Apr. 14, 2011

(51) Int. Cl.
*A24D 3/06* (2006.01)

(52) U.S. Cl. ..... 131/337; 131/274

(58) Field of Classification Search ..... None
See application file for complete search history.

(56) References Cited

U.S. PATENT DOCUMENTS

| | | | |
|---|---|---|---|
| 2,808,057 | A | 10/1957 | Jaksch |
| 3,361,137 | A | 1/1968 | Watson |
| 4,123,592 | A | 10/1978 | Rainer et al. |
| 4,966,171 | A | 10/1990 | Serrano et al. |
| 4,992,326 | A | 2/1991 | Dabi |
| 5,269,329 | A | 12/1993 | Geer et al. |
| 5,465,739 | A | 11/1995 | Perfetti et al. |
| 5,499,636 | A | 3/1996 | Baggett, Jr. et al. |
| 5,666,976 | A | 9/1997 | Adams et al. |
| 5,692,525 | A | 12/1997 | Counts et al. |
| 5,692,526 | A | 12/1997 | Adams et al. |
| 6,026,820 | A | 2/2000 | Baggett, Jr. et al. |
| 6,475,288 | B1 | 11/2002 | Oliver |
| 6,631,722 | B2 | 10/2003 | MacAdam et al. |
| 6,645,305 | B2 | 11/2003 | Oliver |
| 6,863,074 | B2 | 3/2005 | Xue et al. |
| 6,959,712 | B2 | 11/2005 | Bereman et al. |
| 2005/0000531 | A1 | 1/2005 | Shi |
| 2005/0166933 | A1 | 8/2005 | Lesser et al. |
| 2006/0130861 | A1 | 6/2006 | Luan et al. |
| 2010/0294290 | A1 | 11/2010 | Zhang |

FOREIGN PATENT DOCUMENTS

| | | |
|---|---|---|
| GB | 996141 | 6/1965 |

OTHER PUBLICATIONS

International Search Report and Written Opinion mailed Feb. 23, 2011 for PCT/EP2010/006105.

International Preliminary Report on Patentability mailed Apr. 11, 2012 for PCT/EP2010/006105.

*Primary Examiner* — Michael J Felton
(74) *Attorney, Agent, or Firm* — Buchanan Ingersoll & Rooney PC

(57) ABSTRACT

A process for producing a coated filter plug for a smoking article including: (a) incorporating an additive to a porous filter plug, thereby obtaining an impregnated filter plug; (b) coating a surface of the impregnated filter plug with a cross-linkable polymer material; and (c) cross-linking the cross-linkable polymer material, to form a cross-linked, breakable coating substantially enclosing the impregnated filter plug. The process may further include at least partially coating the impregnated filter plug with a cross-linking agent prior to, or subsequent to, coating with the cross-linkable polymer material.

10 Claims, 2 Drawing Sheets

COATED IMPREGNATED POROUS FILTER PLUG

SUMMARY

Flavorant additives can be added to tobacco products such as cigarettes to provide a pleasurable sensory experience. One of the more common flavorants is menthol due to its mint flavoring and cooling effects that can be imparted to tobacco smoke. Additives, such as menthol, can be volatile and have a propensity to evaporate or migrate during handling and storage. Other additives may decompose when exposed to the environment for a relatively long period of time. These may lessen the effects that the additives can impart to smoking products.

Microencapsulation of additives may help to reduce migration of the additives and thus can give a longer shelf life to articles containing them. However, this process typically involves the manufacture of multiple microcapsules to provide sufficient encapsulated additives for a single article, which can complicate the manufacturing process. In addition, an oil carrier is often used in the manufacture of liquid core capsules, which may delay additive release.

As another example, sorbent materials, such as activated carbons, can be employed in smoking articles to remove targeted constituents of tobacco smoke by means of absorption and/or adsorption of targeted constituents into or onto the sorbent.

Activated carbons are sorbent materials that can have a relatively large sorbent capacity and a relatively low cost. However, while activated carbons are effective in removing targeted constituents of tobacco smoke, they can also sorb other components, such as flavorants present in the smoking article. This sorption of flavorants can be detrimental because it can reduce the level of flavoring in the mainstream smoke. In addition, flavorant sorption can be detrimental to the activated carbon itself. Sorption of flavorant can deactivate sorption sites and thereby reduce sorption capacity as the sorbed flavorants fill available sorbent sites on or in the activated carbon.

Accordingly, a simple and convenient process that provides additives in smoking articles, wherein the additives are prevented from migration, sorption and/or decomposition prior to use would be of commercial interest.

According to an embodiment, a process for producing a coated filter plug for a smoking article comprises: (a) incorporating an additive in a porous filter plug, thereby obtaining an impregnated filter plug; (b) coating a surface of the impregnated filter plug with a cross-linkable polymer material; and (c) cross-linking the cross-linkable polymer material, to form a cross-linked, breakable coating substantially enclosing the impregnated filter plug.

In the coated filter plug, the additive is entrapped or encapsulated and thus undesired migration, evaporation, contamination, and/or decomposition due to, e.g., oxidation or moisture that can occur during handling and/or storage of the additive can be reduced, thereby substantially improving the shell life of the additive-containing filter plug.

BRIEF DESCRIPTION OF THE DRAWING FIGURES

DETAILED DESCRIPTION

Figure 1:
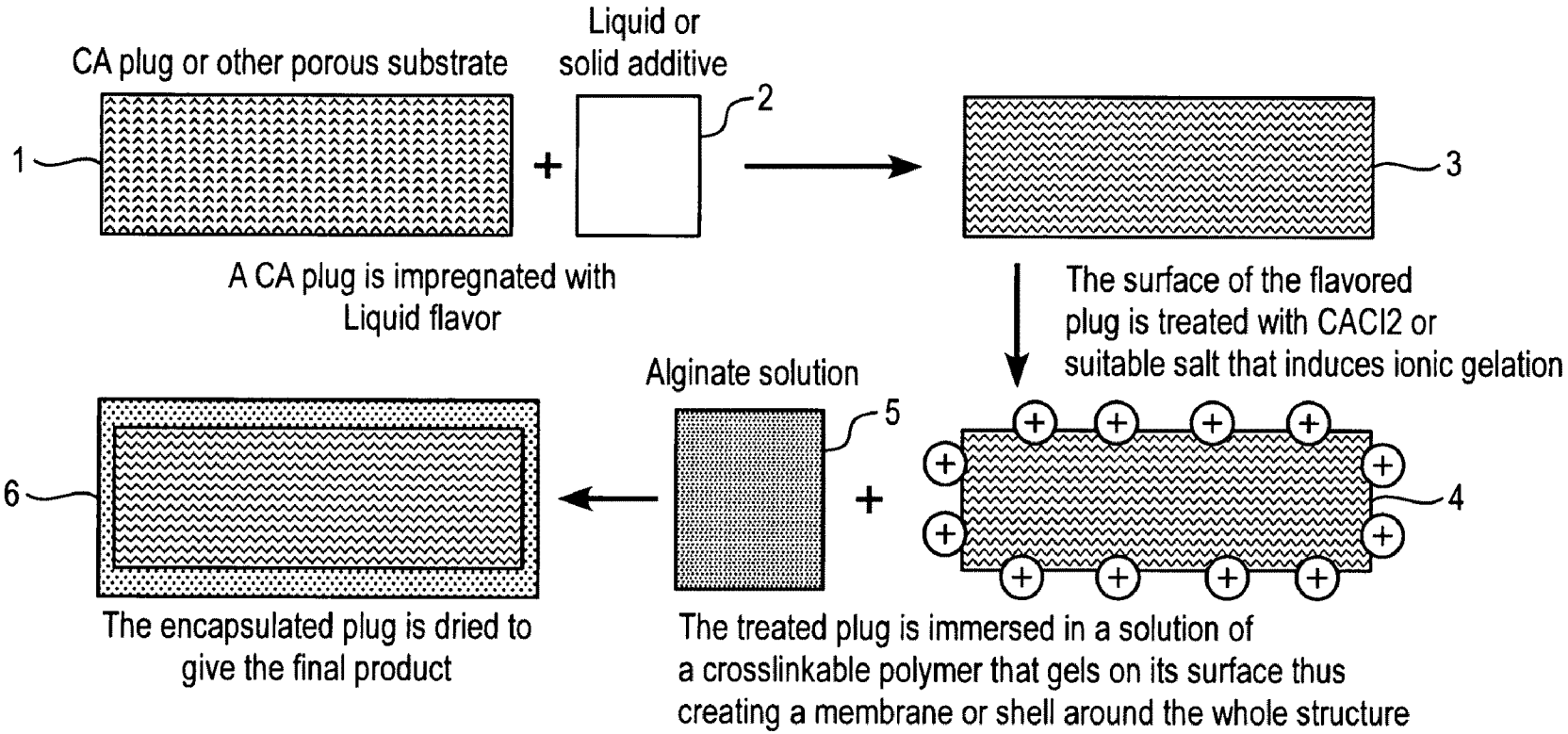
FIG. 1 is a schematic diagram showing steps in an exemplary process for forming a coated cellulose acetate (CA) filter plug.

A coated filter plug of a smoking article can be prepared by (a) incorporating an additive in a porous filter plug, thereby obtaining an impregnated filter plug; and (b) forming a cross-linked, breakable coating substantially enclosing the impregnated filter plug.

The coated filter plug is preferably a rod or column having substantially the same diameter as a rod of smoking material. A smoking article may contain a single coated filter plug and optionally one or more other filter plugs. Alternatively, multiple coated filter plugs may be used together in a single smoking article. When multiple coated filter plugs are used, they may be impregnated with the same or different additives, such as flavorants and sorbents. In this configuration, undesired mixing of different flavorants and/or sorbents can be reduced prior to consumption.

As used herein, the terms "impregnate," "impregnating," "incorporate," and "incorporating" denote infusing or permeating particles of one substance into, or depositing particles of one substance onto, another substance. In an embodiment, a gaseous, liquid, or solid substance may be impregnated in a solid carrier material.

As used herein, the term "flavorant" not only denotes one or more compounds that are perceived by taste receptor or olfactory sensory cells of a consumer, but also includes compounds that are perceived by additional senses as well.

As used herein, the term "sorbent" denotes a material capable of taking up and retaining a component of a vapor or liquid mixture, and is intended to include absorbents and adsorbents.

As used herein, the term "porous" denotes a material having pores therein, wherein the pores are of sufficient diameter and are sufficiently interconnected to allow a liquid, a vapor or a gas to pass through the material.

As used herein, the term "natural polysaccharide" denotes naturally existing polysaccharides.

As used herein, the term "modified cellulosic material" denotes cellulose derivatives which are derived from naturally existing cellulose compounds, by chemically modifying the functional groups in the cellulose compounds. An exemplary modified cellulosic material is a cellulose ester.

As used herein, the term "substantially enclosing" denotes covering essentially the entire outer surface of a filter plug. In a preferred embodiment, the substance enclosed in a substantially enclosed filter plug does not penetrate through the enclosure.

As used herein, the term "cross-linking" or "cross-linked" is intended to refer to joining two or more molecules or segments of individual polymer chains through covalent or non-covalent bonding, including hydrogen bonding or ionic gelation.

As used herein, the term "smoking article" denotes an article containing a charge of smoking composition formed into a rod or column, and which may optionally be surrounded by a wrapper, which helps to hold the shape of the rod and contain the smoking composition within the smoking article. The rod of smoking material, or the wrapper therefor, or both, can be burned or heated during use of the smoking article under smoking conditions. A smoking article may also contain a cylindrical filter aligned in an end-to-end relationship with the tobacco rod ("filtered smoking article"). A filter may comprise one or more filter plugs, which can function to remove targeted constituents from, and/or provide aesthetically pleasing qualities to, the smoke. A filter plug may be formed from a tow of filtering materials, such as cellulose acetate, circumscribed by a paper material known as "plug wrap." The opposite ends of the plug wrap can be secured together with a plug wrap adhesive. For example, the filter plug can be attached to one end of the tobacco rod using a circumscribing wrapping material known as "tipping paper." The term "smoking article" is intended to include cigarettes, which include both traditional cigarettes and non-traditional cigarettes.

As used herein, the term "traditional cigarette" denotes a cigarette that can be smoked by lighting an end of a wrapped rod or column of a smoking composition and drawing air predominantly through the lit end by suction at a mouthpiece end of the cigarette.

In addition, non-traditional cigarettes include, but are not limited to, cigarettes for electrical smoking systems as described in commonly-assigned U.S. Pat. Nos. 6,026,820; 5,692,526; 5,692,525; 5,666,976; and 5,499,636. Other non-traditional cigarettes include those having a fuel element in the tobacco rod as described in U.S. Pat. No. 4,966,171.

The cross-linked coating can be formed by (i) at least partially coating the impregnated filter plug with a cross-linking agent, (ii) coating with a cross-linkable polymer material, and (iii) cross-linking the cross-linkable polymer material, in this order.

Alternatively, the cross-linked coating can be formed by (i) coating the impregnated filter plug with a cross-linkable polymer material, (ii) at least partially coating with a cross-linking agent, and (iii) cross-linking the cross-linkable polymer material, in this order.

In one embodiment, the outer coating of the coated filter plug can be sufficiently pressure sensitive that it is breakable by a mechanical action, for instance, by squeezing or chewing. Upon such breaking of the outer coating, the encapsulated additive can be released to, and/or interact with, the surrounding environment including smoke through the resulting opening or openings, thereby providing controlled release of the additive. Various mechanisms for the further release and transport of the additive include evaporation, diffusion, dissolution, or combinations of these or other mechanisms. The precise mechanisms involved will depend to some extent on the medium surrounding the coated filter plug.

Filter Materials

The porous filter plug may comprise one or more of porous and non-porous filter materials. Examples of suitable porous materials include, but are not limited to, a nonwoven material, a porous foam, cellulose acetate (CA) fibers and the like. Examples of suitable non-porous materials include, but are not limited to, a water-swellable polymer, a hydrophilic polymer and the like. Examples of suitable water-swellable polymers include, but are not limited to, hydroxypropyl methylcellulose, low substituted hydroxypropyl cellulose, hydroxypropyl cellulose and the like. Further, examples of suitable hydrophilic polymer include, but are not limited to, esters of polyvinyl alcohols, polysaccharides, alginates, pectins, gelatins, modified cellulosic materials, starches, superabsorbent polymers and mixtures thereof.

The filter plug may also contain, as the filter material, natural leafy or fibrous materials such as tobacco, cotton, cellulose, etc., which may be porous or non-porous.

Preferably, a porous material is used as the filter material. More preferably, the filter plug contains cellulose acetate fibers. For example, cellulose acetate fibers are bonded to form a rod of CA tow, which is then surrounded by a plug wrap to form a CA filter plug. Incorporation of additives may be performed prior to, during, and/or subsequent to the formation of the CA filter plug.

Additives

The additive to be encapsulated can be liquid, solid or gaseous. Preferably, the additive comprises a flavorant or a sorbent.

Examples of suitable flavorants include, but are not limited to, menthol, peppermint, spearmint, wintergreen, cinnamon, chocolate, vanillin, licorice, clove, anise, sandalwood, geranium, rose oil, vanilla, lemon oil, cassia, fennel, ginger, ethyl acetate, isoamyl acetate, propyl isobutyrate, isobutyl butyrate, ethyl butyrate, ethyl valerate, benzyl formate, limonene, cymene, pinene, linalool, geraniol, citronellol, citral, peppermint oil, orange oil, coriander oil, borneol, fruit extract, tobacco flavor, e.g., tobacco extract, and the like. These flavorants may be used individually or in combination thereof. Preferably, the flavorant comprises menthol.

The sorbent may be any material which has the ability to adsorb and/or absorb gaseous constituents on the surface thereof or to assimilate such constituents into the body thereof. Examples of suitable sorbent materials include, but are not limited to, carbons such as activated carbon and charcoal, aluminas, molecular sieves, silica gels, zeolites and polymeric resins. These sorbents may be used alone or in combination thereof.

Outer Coating Material

Preferably, the coating can be formed from a cross-linkable polymer material. Examples of suitable cross-linkable polymer materials include, but are not limited to, one or more natural polysaccharides, such as alginates, carageenan, pectinates, gums and the like, or a modified cellulosic material such as cellulose esters and the like. Cross-linking may be affected by a cross-linking agent.

Brittleness is a property or condition of a material that causes failure or breakage of the material when it is deformed, e.g., by bending. It can be thought of as the inability of the material to undergo plastic deformation. In the present application, the brittleness of the outer coating may be controlled by selection of the cross-linking material, use of a plasticizer, and/or by control of the quantity and type of cross-linking. More and shorter cross-links can generally impart higher brittleness. Further, increasing cross-linking density of a polymeric material can increase the brittleness thereof.

Examples of suitable plasticizers include, but are not limited to, monoacetin, diacetin, triacetin, glycols such as polyethylene glycol and propylene glycol, polyhydric alcohols such as glycerin and sorbitol, mineral oils, vegetable oils, and glycerol esters such as glycerol triacetate. Increased levels of plasticizer generally decrease brittleness.

In addition, the use of mineral fillers, such as calcium carbonate, clays and the like, in the coating formulation may also affect the coating strength and plasticity.

A certain level of brittleness is desirable because it allows the coating to be mechanically ruptured when deformed, e.g., by squeezing and/or chewing. In one embodiment, the coating of a coated filter plug has a burst strength ranging from about 3 N to about 10 N. Burst strength or failure under compression can be determined using a strength gauge or an Instron testing instrument in compression mode.

In other embodiments, a less brittle, more ductile coating may be used, so that when the coating comes in contact with the mouth, the coating swells and the additive, such as flavorants, may diffuse through the outer coating. In addition, chewing may cause sufficient deterioration of the outer coating (e.g., by stretching it past its plastic deformation) to allow for the release of the additive.

Method of Incorporation

An additive may be introduced or incorporated into a filter plug by any suitable method. Incorporation may be carried out prior to, during, or subsequent to the formation of the filter plug from a filter material. The distribution pattern of the additive in the filter plug is not particularly limited. That is, the additive may be incorporated in the filter plug uniformly or non-uniformly.

In one embodiment, a filter material can be placed in contact with the additive, which may be in its pure form, or which may be dissolved or dispersed in a suitable medium, such as a solvent, and thus become incorporated into the filter material. Examples of suitable solvents include, but are not limited to, water, alcohols, ethers, ketones, glycols and mixtures thereof.

In another embodiment, the additive may be applied, for example, by dipping and spraying, to a filter plug formed from a filter material.

This incorporation can result from wetting or capillary action, or from adsorption and/or absorption of the additive by the filter material. For example, a liquid additive formulation may be incorporated into, the spaces between fibers of a fibrous porous filter material. Alternatively, or in addition, a solid additive formulation may be dispersed in the filter material. In addition, a volatile solid additive formulation may be sublimed and condensed onto a filter material. Furthermore, an additive in a gaseous formulation may be absorbed and/or adsorbed in the pores of a porous filter material. After being incorporated or impregnated with the additive, the filter material may optionally be subjected to a drying step.

The amount of additive to be incorporated within the filter material may vary depending on the nature thereof and the desired results and/or experience of the additive. In addition, the amount of additive in the unit mass of the impregnated filter plug will depend on the holding capacity (or void space) of the filter plug prior to impregnation. For example, menthol may be incorporated for practical purposes in an amount of up to about 40 wt. %, and preferably of about 5-10 wt. %, based on the weight of a filter material such as CA fibers. The upper limit of impregnation is defined by a saturation capacity for the medium being impregnated.

Method of Coating Formation

Any suitable method of encapsulation may be used to form the coating around the filter plug. In an embodiment, an impregnated filter plug can be first coated, at least partially, with a cross-linking agent, and then coated with a cross-linkable polymer material. The cross-linkable polymer material cross-links, when comes in contact with the cross-linking agent, to form the coating. In another embodiment, an impregnated filter plug can be first coated with a cross-linkable polymer material, and then at least partially coated with a cross-linking agent which cross-links the cross-linkable polymer to form the coating. Preferably, the cross-linkable polymer material completely covers the surfaces of the impregnated filter plug.

Selection of the cross-linking agent depends, to some extent, on the nature of the cross-linkable material to be used. For instance, polysaccharides such as alginates, pectinates, carrageenans and gums may be caused to form a coating by ionic gelation. Therefore, when such polysaccharide is used as the cross-linkable polymer, a salt solution containing cations can be preferably used as the cross-linking agent. More preferably, multivalent cations or monovalent cations (depending on the nature of the polysaccharide) are contained in the solution, e.g., an aqueous or alcoholic solution with multivalent cations therein. Examples of suitable multivalent cations include, but are not limited to, calcium, iron, aluminum, manganese, copper, zinc, and lanthanum. Examples of the monovalent cations include potassium, which, in particular, can be used to cross-link carrageenans.

More preferably, the multivalent cations are provided as multivalent cation solutions of lanthanum or calcium salts. Still more preferably, calcium salts, such as calcium acetate, calcium chloride or other calcium salts are provided in the multivalent cation solutions, and can be applied to cross-link various polysaccharides. For example, certain types of pectin and alginate can be gelled in the presence of calcium ions.

FIG. 1 is a schematic diagram that illustrates an exemplary process for encapsulating a CA filter plug. First, a CA filter plug 1 comprising a rod of cellulose acetate tow surrounded by plug wrap is impregnated with a liquid or solid flavorant 2. Then, the flavorant impregnated CA filter plug 3 is treated with $CaCl_2$ or other suitable salt that induces ionic gelation. As shown, the surface of the so-treated CA filter plug 4 bears positive charges. The treated CA filter plug 4 is then immersed in a solution of a cross-linkable material, such as an alginate. As the alginate or other cross-linkable material comes into contact with the cations on the surface of the filter plug, it cross-links and forms a gel on the filter plug. Excess cations can diffuse through the coating, cross-linking any excess alginate or other polymer thereon. The amount of cations on the filter surface and the amount of alginate or other cross-linkable polymer can thus be used to control the thickness of the coating. In an embodiment, the filter plug comprises a cylindrical filter plug with an aspect ratio (length/diameter) of 1 to 10. The formed coating 6 substantially encloses the impregnated filter plug. The encapsulated CA filter plug may then optionally be washed to remove any excess polymer and/or cations, and dried at room temperature. However, for mass production of filter plugs, a continuously formed rod of filter material can be cut into segments of desired size, and then passed through baths of additive, cross-linking agent and polymer material, in sequence.

As a specific example, a CA filter plug comprising a rod of cellulose acetate tow surrounded by plug wrap can be first impregnated, via absorption, with an oil based mint flavorant. It can then be briefly immersed in a $CaCl_2$ solution and then immersed in a 2% alginate aqueous solution, which leads to the formation of a gel (or coating) enclosing the filter plug. The gelled layer can then be dried at room temperature. Alternatively, a CA filter plug can be first impregnated with a flavorant, such as menthol, dipped in a 2% alginate aqueous solution and then immersed in a $CaCl_2$ solution.

In one embodiment, a coated filter plug can comprise: (a) an impregnated filter plug comprising a filter material and an additive, and (b) a cross-linked, breakable coating substantially enclosing the impregnated filter plug.

In a further embodiment, the coating is mechanically breakable, for example, by chewing or squeezing.

Figure 2:
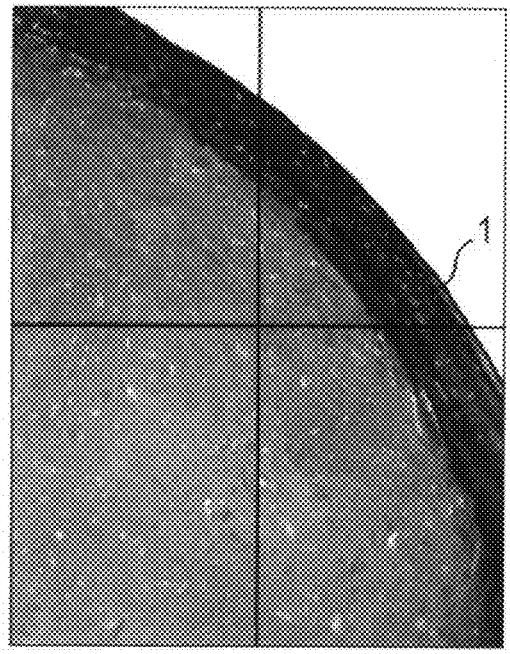
FIG. 2 is a photograph showing a partial cross sectional view of an exemplary CA filter plug impregnated with flavorant and coated according to an embodiment described herein.
Figure 3:
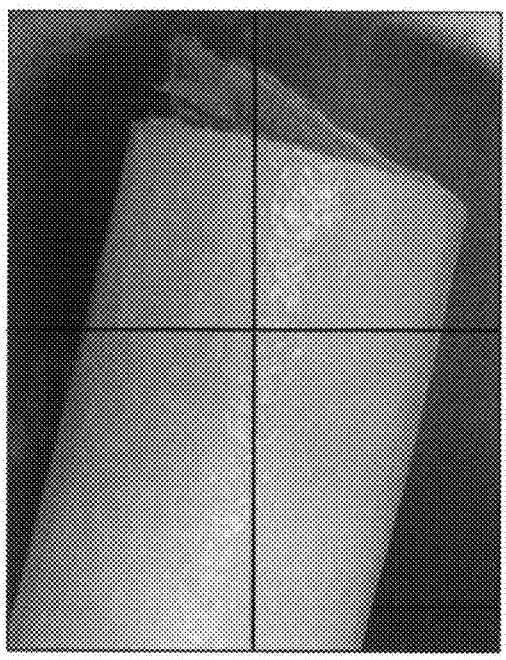
FIG. 3 is a photograph showing an edge of an exemplary CA filter plug impregnated with flavorant and coated according to an embodiment described herein after the coating is peeled off.

FIG. 2 is a photograph showing a partial cross sectional view of an encapsulated CA filter plug obtained according to the procedure described above. The presence of a coating 1 formed around the CA filter plug is visible. FIG. 3 is a photograph showing a close-up view of the edge of the encapsulated flavorant impregnated CA filter plug of FIG. 2, after the protective coating 1 is peeled off.

The coating formed around an impregnated filter plug is desirably a frangible thin shell. In an embodiment, the shell can have a thickness of from 0 (incomplete or partial coating) to about 0.5 mm, depending on the strength required and the type of coating material used.

Those skilled in the art can realize that the thickness of the coating can increase by increasing the time of treatment (residence time in the coating solution) and/or the concentration of the cross-linkable polymer in its solution or through the application of multiple coating (multiple passes) so that the final thickness can be adjusted depending on end use requirements.

Exemplary Applications

As described above, the filter plug for a smoking article may incorporate an additive, for example, a flavorant and/or a sorbent, prior to encapsulation with the coating.

Such coated filter plug can be used within a filter element of any smoking article, e.g., a traditional or non-traditional cigarette comprising a tobacco rod and a filter attached thereto.

The tobaccos used in these traditional or non-traditional cigarette are not particularly limited. Examples of suitable types of tobacco materials include, but are not limited to, cured and uncured tobacco such as flue-cured tobacco, Burley tobacco, Maryland tobacco, Oriental tobacco, rare tobacco, specialty tobacco, reconstituted tobacco, agglomerated tobacco fines, blends thereof, and the like. Preferably, the tobacco material is pasteurized. Some or all of the tobacco material may be fermented.

Further, the tobacco material may be provided in any suitable form. Examples of suitable forms include shreds and/or particles of tobacco lamina, processed tobacco materials, such as volume expanded or puffed tobacco, or ground tobacco, processed tobacco stems, such as cut-rolled or cut-puffed stems, reconstituted tobacco materials, blends thereof, and the like. Genetically modified tobacco may also be used.

Other suitable additives typically used in tobacco composition and filters of smoking articles such as traditional or non-traditional cigarettes may also be added if needed or desired.

The coated filter plug can be the only filter plug in the filter of a smoking article. Alternatively, the coated filter plug can form part of a filter element in combination with other filter plugs. For example, one or more uncoated filter plugs can also be included along with one or more coated filter plugs. In a particular example, a cigarette filter can include an uncoated CA filter plug adjacent to a coated filter plug.

When a flavorant or other additive is encapsulated in a filter plug for a smoking article, the breach of the encapsulating coating by the consumer (e.g., by pressure of lips, teeth, or tongue on the filter end of the smoking article), causes release of the flavorant, which is then contained in mainstream smoke passing through the breached filter plug.

Alternatively or additionally, a suitable sorbent may also be encapsulated in the filter plug. As described above, a sorbent may remove flavor components from a cut filler, or may adsorb and/or absorb other additives during storage or use of the smoking article, causing not only the losses of the taste and additive properties of the smoking article, but also loss of adsorption and/or absorption properties of the sorbent, due to decreased availability of adsorption and/or absorption sites on the surfaces of the sorbent. By encapsulating the filter plug containing such as sorbent using the technique, such contact and/or potential deactivation of the sorbent can be minimized.

Sorbents that are encapsulated in a filter plug of a smoking article, can be isolated from both other additives and fillers, reducing their interactions with other components of the smoking article, as well as the environment. Moreover, the adsorption and/or absorption capability of the sorbent can be preserved during the storage of the smoking articles. Upon breach of the outer coating of the encapsulated filter plug by a consumer, the sorbent becomes available to adsorb and/or absorb targeted constituents in tobacco smoke. A sorbent such as activated carbon may be incorporated in an amount of 0-10, 10-20, 20-30, 30-40 and up to 290-300 mg per cigarette.

While the processes and products have been described herein with reference to specific embodiments, variations and modifications may be made without departing from the spirit and the scope of the invention. Such variations and modifications are to be considered within the purview and scope of the invention as defined by the appended claims.

All of the above-mentioned references are herein incorporated by reference in their entirety to the same extent as if each individual reference was specifically and individually indicated to be incorporated herein by reference in its entirety.

What is claimed is:

1. A process for producing a coated filter plug for a smoking article comprising, in this order:

(a) incorporating an additive in a porous filter plug, thereby obtaining an impregnated filter plug;

(b) coating a surface of the impregnated filter plug with a cross-linkable polymer material; and (c) cross-linking the cross-linkable polymer material, to form a cross-linked, breakable coating substantially enclosing the impregnated filter plug, the coating is capable of being fractured during smoking, the process further comprising at least partially coating the impregnated filter plug with a cross-linking agent, prior to coating with the cross-linkable polymer material.

2. The process of claim 1, wherein the incorporating is carried out prior to, during, or subsequent to formation of the filter plug from a filter material.

3. The process of claim 2, wherein the filter material comprises a nonwoven material, a porous foam, cellulose acetate, a water-swellable polymer, a hydrophilic polymer or a tobacco material.

4. The process of claim 1, wherein the cross-linking is carried out in the presence of a cross-linking agent.

5. The process of claim 1, wherein: (i) the additive comprises one or more selected from the group consisting of a flavorant and a sorbent; and/or (ii) the cross-linkable polymer material comprises a natural polysaccharide or a modified cellulosic material.

6. The process of claim 5, wherein: (i) the flavorant comprises at least one selected from the group consisting of menthol, peppermint, spearmint, wintergreen, cinnamon, chocolate, vanillin, licorice, clove, anise, sandalwood, geranium, rose oil, vanilla, lemon oil, cassia, fennel, ginger, ethyl acetate, isoamyl acetate, propyl isobutyrate, isobutyl butyrate, ethyl butyrate, ethyl valerate, benzyl formate, limonene, cymene, pinene, linalool, geraniol, citronellol, citral, peppermint oil, orange oil, coriander oil, borneol, fruit extract, and tobacco flavor; (ii) the sorbent comprises at least one selected from the group consisting of carbon, aluminas, molecular sieves, silica gels, zeolites, polymeric resins and combinations thereof; (iii) the natural polysaccharide comprises at least one selected from the group consisting of alginates, carageenans, pectinates and gums; and (iv) the modified cellulosic material comprises at least one cellulose ester.

7. The process of claim 6, wherein the flavorant comprises menthol.

8. The process of claim 1, wherein the cross-linking agent comprises a salt solution.

9. The process of claim 8, wherein the salt solution comprises a solution of calcium chloride.

10. The process of claim 1, further comprising incorporating the coated filter plug in a cigarette filter and attaching the cigarette filter to a tobacco rod.

* * * * *